US005333362A

United States Patent [19]

Gillioz

[11] Patent Number: 5,333,362

[45] Date of Patent: Aug. 2, 1994

[54] LEAD-IN DEVICE FOR A SLIDE FASTENER

[76] Inventor: Marc Gillioz, Sentier du Lycée 4, CH - 1009 Pully, Switzerland

[21] Appl. No.: 958,363

[22] PCT Filed: Apr. 29, 1992

[86] PCT No.: PCT/CH92/00086

§ 371 Date: Dec. 22, 1992

§ 102(e) Date: Dec. 22, 1992

[87] PCT Pub. No.: WO92/19120

PCT Pub. Date: Nov. 12, 1992

[51] Int. Cl.[5] ..... A44B 19/00

[52] U.S. Cl. ..... 24/433; 24/434

[58] Field of Search ..... 24/433, 434, 388, 390

[56] References Cited

U.S. PATENT DOCUMENTS

| | | | |
|---|---|---|---|
| 2,039,976 | 5/1936 | Norton | 24/434 |
| 4,078,279 | 3/1978 | Heimberger | 24/434 |
| 4,221,026 | 9/1980 | Kanzaka | 24/433 |
| 4,742,603 | 5/1988 | Kasai | 24/433 |

*Primary Examiner*—Victor N. Sakran

*Attorney, Agent, or Firm*—Woodard, Emhardt, Naughton, Moriarty & McNett

[57] ABSTRACT

The present device comprises a pin (8) affixed to the end of the strip (1) carrying the slider (4) and a plate (14) affixed to the end of the strip (2) carrying the leader (11). After engagement of the head (9) of the pin (8) inside the hole (17), the pin (8) is guided in the channel (18) while pulling the end of the strip (1) so as to position the leader (11) in front of the opening of the slider (4). This device can be operated with one hand.

11 Claims, 3 Drawing Sheets

FIG. 1a
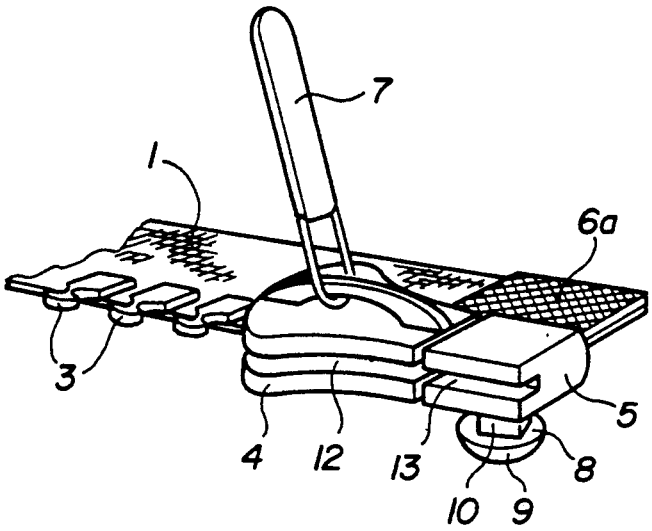
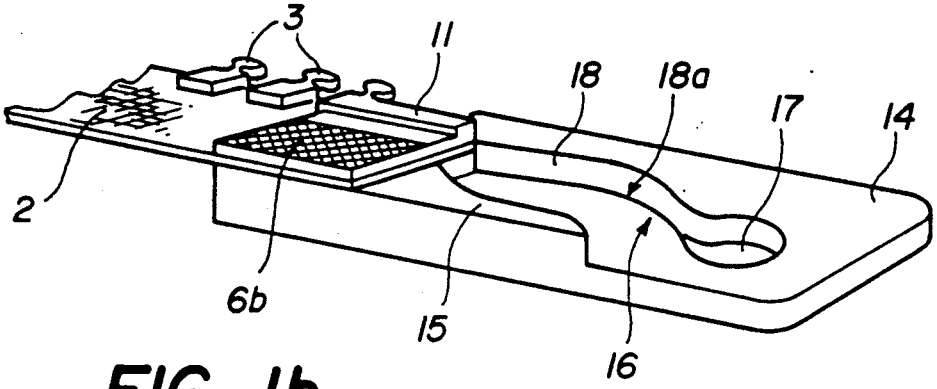
FIG. 1b
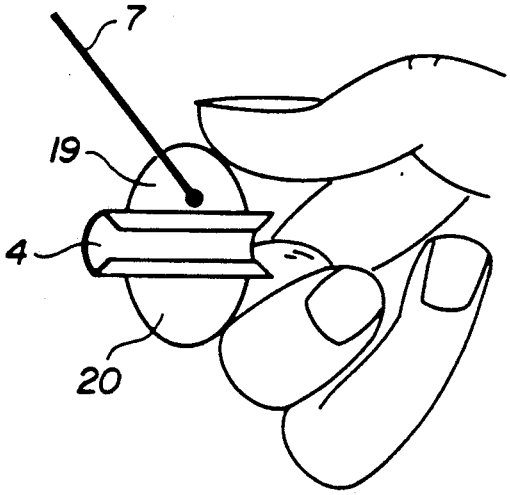
FIG. 3
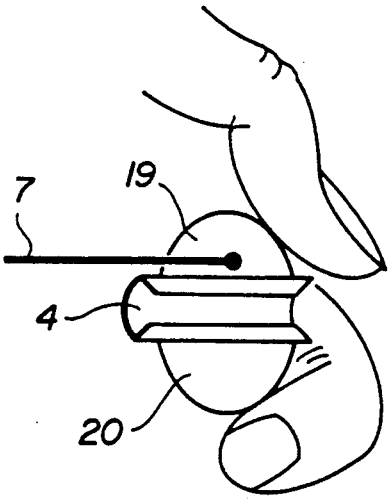
FIG. 4

LEAD-IN DEVICE FOR A SLIDE FASTENER

The present invention is concerned with a lead-in device for a slide fastener, as well as with a slide fastener fitted with this device.

Zip fasteners are well known, which are also called zippers or slide fasteners. They are made of two strips with tabs along the edge of each strip, an end part fastened permanently to the end of one of the strips, which comprises a groove designed for receiving the leader of the other strip and finally a slider adapted permanently on the strip bearing the end part, to slide thereon.

To operate a fastener of this type, it is first necessary to enter the leader of the first strip into the opening of the slider and then to slide it until it enters the end part and abuts finally against its bottom.

The slider can then be pulled to ensure the interpenetration of the tabs of the strips.

One can note, that all the movements are carried out in one plane, i.e. the one to which both strips belong. Although the strips are generally flexible, one can picture this plane without difficulty.

Unless one if of an uncommon dexterity, one must use both hands to carry out the operation of leading-in a slide fastener. One hand guides the leader of the first strip inside the slider and the end part associated with the second strip, which are both held in the second hand.

The introduction of the leader inside the slider can sometimes be difficult, for example when one wears gloves or cannot make his two hands free at the same time.

The aim of the present invention is to provide a lead-in device which does not require the use of both hands.

To this end, the device according to the invention is such as set forth in claim 1.

Figure 5A:
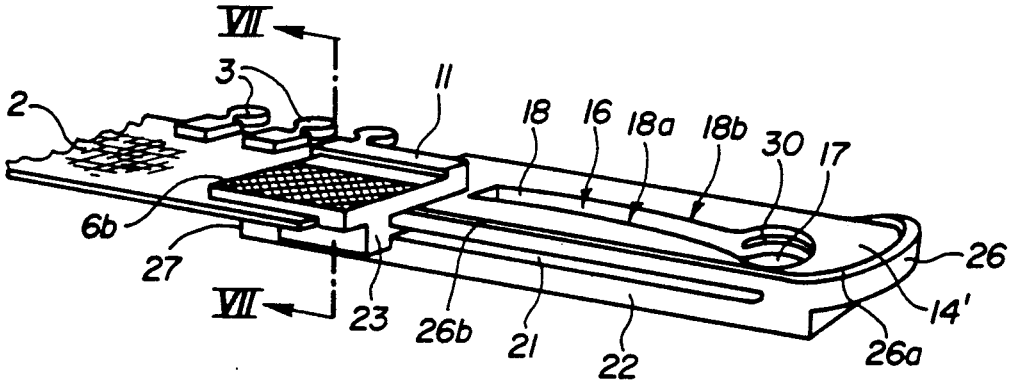
Figure 5B:
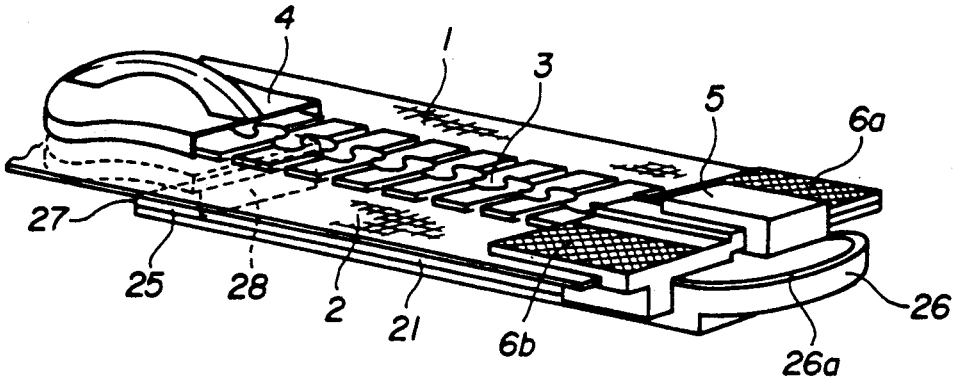
Figure 6:
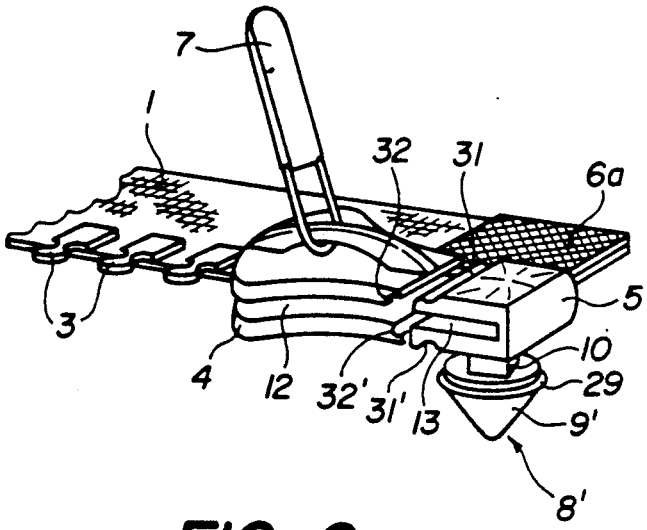
Figure 7:
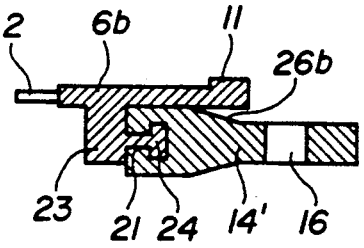

The invention will be better understood from the following detailed description, given as a non limiting example, of two particular embodiments of the device according to the invention, with reference to the appended drawing, in which:

FIG. 1*a* is a perspective view of the end of the strip carrying the slider of a slide fastener, provided with the device of the invention, in accordance with a fist embodiment of this device;

FIG. 1*b* is a perspective view of the end of the strip provided with the leader designed for introduction into the opening of the slider, in accordance with the first embodiment of the device;

FIGS. 2*a*, 2*b*, 2*c* and 2*d* are top views illustrating the functioning of the lead-in device according to the invention;

FIGS. 3 and 4 are diagrammatic views of the slider of the slide fastener, in accordance with one particular embodiment of this slider:

FIG. 5*a* is a perspective view of the end of the strip provided with the leader designed for introduction into the opening of the slider, in accordance with a second particular embodiment of the device according to the invention;

FIG. 5*b* is a perspective view showing the configuration taken by the device according to the second embodiment thereof, after leading-in and initiating the closing, with a sliding guide member being placed in a retracted position;

FIG. 6 is a perspective view similar to FIG. 1*a*, showing another version of the device, which can be applied to one or the other of the two embodiments of this device illustrated in FIGS. 1*a* to 5*a*; and FIG. 7 is a cross-sectional view of the device according to the embodiment shown in FIG. 5*a*, at a larger scale than in the latter figure and taken along the plane VII—VII indicated therein.

Before proceeding with the actual description, it should be specified that the version described is concerned with a fastener intended for a garment, such as a jacket or a blazer. The illustration given assumes that the slider is mounted on the left side of the blazer. Clearly, a simple inversion will not affect in any way the functioning of the device, so that the device can also be adapted to the case where the slider is borne by the strip of the fastener affixed to the other side.

Also, the figures are intended to illustrate as well as possible the device and the components useful for its functioning; the shapes and the proportions are therefore purely illustrative and are not intended to be limiting in any way.

As shown in FIG. 1*a*, the first strip 1 of the fastener with the tabs 3 along the edge is provided with a slider 4 and an end part 5 affixed to the end of the strip 1. A roughened plate 6*a*, also affixed to the end of the strip 1, carries a leader (not shown in FIG. 1*a*), one part of which is nipped in the end part 5, while the remainder enters into the slider 4 when the latter abuts at the end of its travel, against the end part 5. A pin 8, comprised of a rod 10 which can have a prismatic shape as shown in the FIG. 1*a*, but which can also have any other suitable shape, for example cylindrical or conical, and of a hemispherical head 9, forming a flange around the rod 10, is integral with the face of the end part 5 opposite the face which is on the same side as the face of the slider 4 carrying the tongue 7.

As illustrated in FIG. 1*b*, the second strip 2, also with tabs 3 along the edge, carries at its end a leader 11, which provides the first tab of the strip and which is constructed so that it can be introduced inside the free opening of the slider 4 (FIG. 1*a*) and slide through the side groove 12 of the latter, then in the side groove 13 of the end part 5, to a final locking position, in a manner known per se. The leader 11 is carried by a roughened plate 6*b*, which is affixed to the end of the strip 2 and which is similar to plate 6*a* of the strip 1.

A guiding plate 14, which can be of a generally rectangular shape as illustrated in FIG. 1*b*, but which could also have any other appropriate shape, for example an oval or a circular shape, is affixed in the vicinity of one of its ends, to the end of the strip 2, to extend beyond and in the prolongation thereof, via a thicker section 15, which is directly applied on the face of the end of the strip 2 opposite the face on which the plate 6*b* is placed.

The thickness of section 15 is such that when the slider 4 is applied on the guiding plate 14, the groove 12 of the slider 4 is exactly at the same level as the leader 11. The thickness of the remainder of plate 14 is very slightly inferior to the length of the rod 10 of the pin 8.

It should be noted that the roughened plates 6*a* and 6*b* are already used in conventional slide fasteners and that they allow the passage of the needles of a sewing machine for fastening them to the ends of respectively the strips 1 and 2 of the fastener. In the case of the device according to the present invention, the plates 6*a* and 6*b* are advantageously moulded together with respectively the end part 5 and the guiding plate 14. Depending on the requirements of the designer of the clothes—for example jackets—on which the slide fasteners having the lead-in device according to the invention are to be mounted, the plates 6*a* and 6*b* can possibly be extended to the ends of strips 1 and 2, and even beyond.

The guiding plate 14 has an opening 16 cut out perpendicularly to its main faces. The opening 16 consists mainly of a circular hole 17 of a diameter slightly larger than that of the head 9 of the pin 8 (FIG. 1*a*) and which is located in the vicinity of the end of the plate 14 opposite to the end which is affixed to strip 2, and of an elongated channel 18 starting at hole 17 and extending to the portion of the plate 14 adjoining the thicker portion 15. Specifically, the channel 18 is limited by two edges 18*a* and 18*b* shaped as arcs of a circle, which are spaced by a distance remaining substantially constant and slightly greater than the thickness of the rod 10 of the pin 8, with one protruding edge 18*a* ending on the side opposite the hole 17, approximately beneath the leader 11. It should be noted, that the length of the plate 14, as well as that of the channel 18, are determined according to the dimensions of the slider 4 and of the end part 5. It is therefore possible to decrease the length of the plate 14 (and that of the channel 18) by shortening the slider 4, for example by one half.

The device which has just been described, functions as follows:

From a starting open position, illustrated in FIGS. 1*a* and 1*b*, where the two strips 1 and 2 of the slide fastener are spaced from each other with the slider 4 abutting against the end part 5, the pin 8 is first introduced into the hole 17 from the side of the plate 14 facing upwards in FIG. 1*b*, so that the faces of the end piece 8 and of the slider 4, opposite the face of the slider 4 carrying the tongue 7, are applied flat against the upper face of the plate 14.

Because of the fact, mentioned above, that the thickness of the plate 14 is slightly less than the length of the rod 10 of the pin 8 and that the diameter of the hole 17 is slightly larger than that of the head 9 of the pin 8, the edge of the head 9 grips spontaneously the lower face of the plate 14 (i.e. the face opposite to the face on which are applied the end part 5 and the slider 4), thus producing an interlocking of the ends of the two strips 1 and 2.

Advantageously, one can further add to the device a member such as a spring clip or a clip which, on the one hand, enables to feel when the pin 8 is introduced inside and grips the hole 17, and on the other hand, makes this grip safer.

Clearly, a similar effect to that of a clip can possibly be achieved, without the provision of other components than those of the particular embodiment described in detail above, for example by forming in an appropriate manner the male member 8 and the female member 16 and in particular by conferring a spheroidal shape to the head 9 of the pin 8, while adapting the diameter of the hole 17 and the elasticity of the plate 14 so that the passage of the head 9 through the hole 17 requires overcoming a certain degree of mechanical resistance.

Figure 2A:
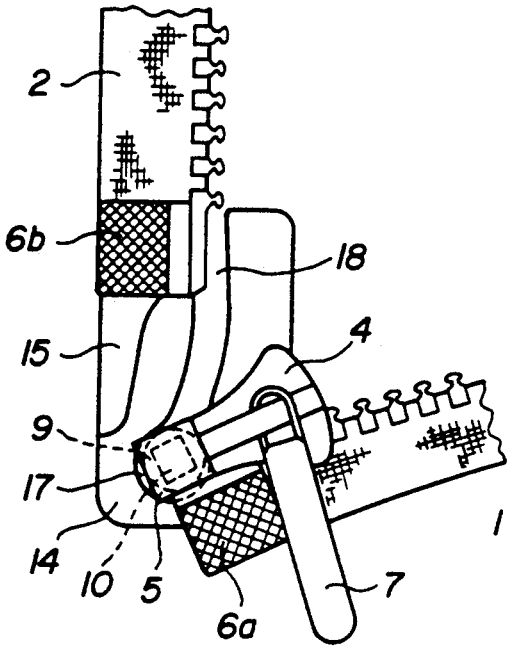

In the locked position illustrated in FIG. 2*a*, the ends of the strips 1 and 2 are free to pivot around the axis of the rod 10 of the pin 8 in a common plane defined by the main faces of the plate 14. This pivoting movement proceeds spontaneously when a slight downward pull is exerted on the strips 1 and 2, by holding the plate 14 in one hand, advantageously between the thumb and the forefinger, while maintaining the head 9 of the pin 8 gripping the edge of the hole 17. Thus, the strips 1 and 2 tend to move towards each other and the slider 4 is moved with a circular sliding motion while remaining applied against the plate 14, to shift from the position shown in FIG. 2*a* to that of FIG. 2*b*, without however the slider 4 having the possibility of moving beyond its ideal position of engagement on the leader 11, owing to the presence of the thicker portion 15, which functions as a stop.

Figure 2B:
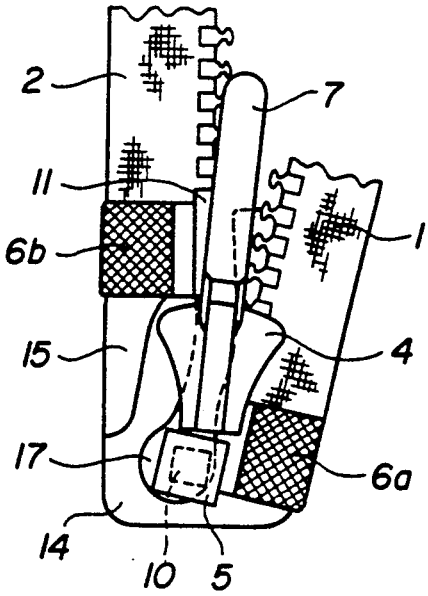

It should be noted that during this first movement, the pin 8 remains gripping the edge of the circular hole and the slider 4 is pressed against the end part 5 or is separated therefrom only by a short distance. However, the opening of the slider into which the leader 11 is to be introduced, comes in front of the latter, as illustrated in FIG. 2*b*.

Figure 2C:
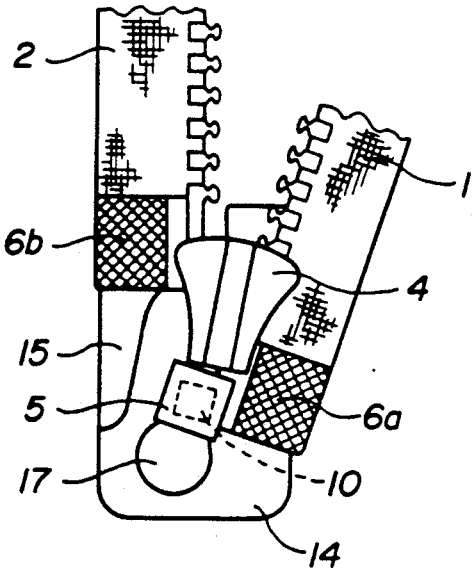
Figure 2D:
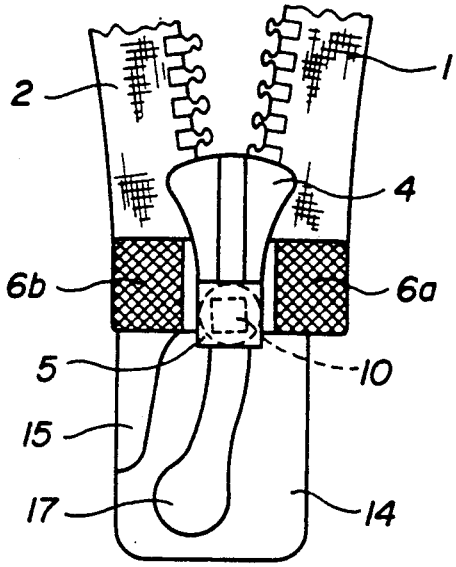

One then only needs to push the pin 8 or to pull the plate 14, which causes the engagement of the pin 8 inside the channel 18 and its motion, guided by the sliding of the edges of the rod 10 along those of the channel 18, in the direction of the end of the channel 18 opposite the hole 17, to introduce the leader 11 inside the opening of the slider 4, as shown in FIG. 2*c*, then to continue this motion in the side groove 13 of the end part 5 to the final locking position illustrated in FIG. 2*d*.

As shown in FIG. 1*a*, and further in FIGS. 2*a* to 2*d* which illustrate by broken lines the rectangular shape of the rod 10 of the pin 8 in cross-section (in the particular embodiment illustrated in the drawing), the median vertical plane of the rod 10 is angularly offset with respect to that of the end part 5, in a direction (i.e. leftwards in the top views of FIGS. 2*a* to 2*d*), such that the leader 11 be positioned exactly on the axis of the groove 13 of the end part 5.

From the position of FIG. 2*d*, one only needs to move the slider 4 upwards, for example by pulling the tongue 7 in the usual manner, to achieve the closing of the fastener.

According to the preceding description, one will understand that the device according to the invention is of a very simple construction and easy to manufacture industrially, without increasing significantly the overall cost of a slide fastener fitted with this lead-in device, by comparison with a fastener not including this lead-in device. Actually, this lead-in device can be made of two parts which are very simple, namely the male guiding and operating member, such as the pin 8, and the guiding plate 14. Furthermore, it is clear that the pin 8 and the end part 5 can be made as a single component, for example by moulding or injection-moulding from a plastic material or a metal. Of course, additional components can be combined with the basic components which have just been described.

In FIG. 3, one can see the slider 4 provided with protrusions of a hemispheroidal or a hemiovoidal shape, namely an upper protrusion 19 and a lower protrusion 20. The squeezing between two fingers, e.g. the thumb and the forefinger, makes possible the forward motion of the slider, while taking advantage of a sort of a support point which the other fingers provide by holding on the one hand, the strips 1 and 2, and on the other hand, the cloth of the garment. This makes it possible to avoid the crumpling of the fastener or of the cloth, which unavoidably occurs when one simply pulls the tongue when the strips have just been engaged inside the slider. As a result of the pressure which can be exerted on the protrusions, the slider is projected as a cherry stone would be.

In FIG. 4, one can see the same components as in FIG. 3, with the difference that the slider is projected inwards of the hand, with the fingers pressing upon the protrusions of the slider, while the hand is positioned between the two strips still separated.

The means for projecting the slider by squeezing it between two fingers could of course be constructed in any other suitable manner, for example they could consist of laterally extending protrusions shaped to provide the "cherry stone" propulsion effect. One can also achieve a propulsion effect through squeezing, simply by conferring an appropriate shape to the side edges of the slider or by providing a protruding portion integral with its upper or lower face.

The embodiment of the device shown in FIGS. 5*a*, 5*b* and 7 is similar to that illustrated in FIGS. 1*a* and 1*b* and the components of this embodiment which are identical or similar to those of the first embodiment just described, will be designated in the following description and in the drawing, by the same reference numerals as in FIGS. 1*a* and 1*b*.

The main difference between the embodiment as shown in FIG. 5*a* and that of FIG. 1*b*, lies in the fact that the guiding plate 14', which otherwise fulfils the same function as the plate 14, is not assembled fixedly with the plate 6*b*, but on the contrary, is designed to slide with respect to the latter, between a position of maximum extension illustrated in FIG. 5*a* and a retracted position illustrated in FIG. 5*b*.

To this end, the plate 14' has an elongated groove 21 which extends longitudinally over the major part of its length and opens on one of its side faces 22, to provide a slideway which is shown in cross-section in FIG. 7.

The inner face (corresponding to the lower face in FIG. 5*b*) of the plate 6*b* is provided with an extension 23, advantageously integrally molded with the remainder of the part 6*b*, which bears a rail 24 (FIG. 7), the cross-section of which corresponds to that of the groove 21 and which is slidably engaged in the latter to allow a translatory motion of the plate 14' between the two extreme positions shown respectively in FIG. 5*a* and in FIG. 5*b*.

Advantageously, the groove 21 extends to an opening (not illustrated) in the back face of the plate 14', so as to enable the insertion of the rail 24 inside the groove 21, and a stop 25 (one side face of which can be seen in FIG. 5*b*) is placed in the groove 21 after this assembling, in order to limit the motion of extension of the plate 14' and thus to prevent it from disengaging from the part 6*b*.

The front edge 26 of the plate 14' is curved and forms a flange 26*a*, which extends above the upper surface of the plate 14' and is continued by a surface 26*b* to the back end of plate 14'. This flange 26*a* provides a guiding member for the head 9 or 9' (FIG. 6) of the pin 8 or 8' (FIG. 6) when leading-in the slide fastener and it facilitates the carrying out of this leading-in operation with one hand.

Advantageously, the portion of the plate 14' adjoining the back edge 27 thereof is provided, on the portion of its upper face which slides on the lower face of the plate 6*b*, with a member such as a boss or a clip (not illustrated) cooperating with a corresponding cavity (not illustrated either) provided in the lower face of the plate 6*b*, so that one may feel the position of maximum extension of the plate 14' and maintain temporarily the latter in this position.

In the retracted position illustrated in FIG. 5*b*, the back edge 27 of the plate 14' abuts against a gripping member 28 consisting of an extension protruding beneath the lower face of the slider 4, the latter then being pushed along a portion of the length of the slide fastener corresponding to the length of the portion of the plate 14' retracted beneath the lower face of the strips 1 and 2 of the slide fastener (this length corresponding substantially to the totality of the plate, except for the front edge 26 which protrudes to expose the flange 26*a*).

From this position, one only needs to move the slider 4 as mentioned above, to achieve the full or the partial closing of the slide fastener. During the opening of the slide fastener, by moving the slider 4 downwards (which corresponds to the right-hand side of FIG. 5*b*), the latter first abuts again on the back edge 27 of the plate 14' and then pulls the latter towards the position of complete extension shown in FIG. 5*a*. One can however also move the plate 14' to its position of extension, from the retracted position illustrated in FIG. 5*b*, by pulling directly upon the plate 14' while holding it by its front edge 26*a*.

Advantageously, a member such as a boss or a clip (not illustrated) cooperating with a corresponding cavity (not illustrated either) provided in the gripping member 28 of the slider 4 is disposed on the back edge 27 of the plate 14' or in the vicinity thereof, so that the one may feel when the back end of the plate 14' engages the slider, and maintain temporarily this engagement.

Advantageously, the front part of the plate 14' can also be provided with a member (not illustrated) such as a boss or a clip cooperating with a cavity provided in the lower face of the plate 6*b*, which can possibly be the same as that mentioned above, so that one may feel the position of maximum retraction of the plate 14' and hold temporarily this position.

The version of the arrangement illustrated in FIG. 6 corresponds to the portion of the device illustrated in FIG. 1*a*, and the components which are identical or similar in the arrangements according to these two figures are designated by the same reference numerals.

In accordance with the version illustrated in FIG. 6, the head 9' of the pin 8' has a conical shape and exhibits a circular boss 29 along the periphery of the portion adjoining its base, this boss being devised in such a manner that the maximum diameter of the head 9' be slightly larger than that of the hole 17 of the opening 16 of the plate 14' (FIG. 5*a*).

As shown in FIG. 5*a*, the inner face of the hole 17 has a groove 30, the shape and the dimensions of which correspond to those of the boss 29.

The cooperation between the groove 30 and the boss 29, made possible by the elasticity of the materials of which the boss 29 and/or the plate 14' are made, enables the pin 8' to be temporarily held inside the hole 17 during the leading-in operation of the slide fastener, which further contributes to facilitating the carrying out of this operation with one hand.

As one can see in FIG. 6, the back edges of the upper and lower faces of the end part 5 exhibit two respective bosses 31 and 31' cooperating with corresponding hooked portions 32 and 32' provided on the front face of the slider 4. This makes it possible to achieve temporarily an engagement of the slider with the end part, which ensures an optimum guiding of the slider during the leading-in of the slide fastener.

Apart from the additional functions indicated or suggested in the above description and which result from differences of construction between the two embodiments of the device, the functioning of the latter remains substantially identical in the two embodiments described.

It should be stressed, that the relative size and shape of the components and of the members described above, which participate to the functioning of the device, can be modified to a considerable extent without affecting adversely the practice of the present invention.

The most obvious advantage of the lead-in device according to the invention is, of course, that it makes it possible to control the closing of a slide fastener with one hand. However, although the device was illustrated and described for use on a garment, it can also offer appreciable advantages in other areas where slide fasteners are used. One can also assume that the device according to the invention will open new areas for the use of slide fasteners, from which they were excluded up to now because of the drawbacks, which the device is precisely aimed at eliminating.

I claim:

1. A lead-in device for a slide fastener consisting of two strips with tabs along the edge, one of these strips carrying a slider and being provided with an end part affixed to its end, and the other strip being provided with a leader which provides the first tap thereof and which is arranged so that it can be introduced into the opening of the slider, the device comprising means for guiding the positioning of the leader and of the opening of the slider in front of each other; means for entering said leader into the opening of the slider and then into the groove of said end part; and further comprising at least two components, namely a first component affixed to the end of the strip carrying the end part and a second component affixed to the end of the strip carrying the leader, one of these components forming a male coupling member and the other comprising a corresponding female member, these two members being arranged so that, after engagement in the female member, the male member is free to move along a guided trajectory while pulling the end of the strip to which it is affixed, in such a manner as to place the leader and the opening of the slider, into which it is to be introduced, in front of each other, at a position enabling the subsequent introduction of the leader inside the opening of the slider, wherein said male coupling member is formed of a pin consisting of a rod and of a head having a cross-sectional width greater than the rod and in that the second component is formed of a plate, the female member consisting of an opening made perpendicularly to the plane of the plate, comprising a circular hole arranged in such a manner as to allow the passage of the head of the pin and an elongated channel starting at the hole and extending to beneath the leader.

2. A device according to claim 1, wherein said pin and said end piece are formed as a single piece, by moulding.

3. A device according to claim 1, wherein said channel is limited by two edges shaped as arcs of a circle, the protruding edge extending on the side opposite the hole to beneath the leader and in that the vertical median plane of the rod of the pin is angularly offset with respect to that of the end part, in a direction such that the leader be positioned exactly on the axis of the grove of the end part.

4. A device according to claim 1, comprising a member which enables to reinforce and to feel the engagement of the pin inside the hole provided in the plate.

5. A device according to claim 4, wherein the plate comprises a stop designed to prevent the slider from overshooting the position allowing the engagement of the leader into the slider.

6. A device according to claim 1, wherein said plate is assembled with an end part affixed to the end of the strip carrying the leader, said plate being slidably movable with respect to said end part between a position of maximum extension enabling the leading-in operation of the fastener and a retracted position which can be attained both before and after closing the slider fastener.

7. A device according to claim 6, wherein the plate has a longitudinal groove providing a slideway for a rail carried by an extension protruding from the inner face of the end part.

8. A slide fastener provided with the lead-in device according to claim 1, wherein the slider is provided with propulsion means, arranged so that it can move forward when they are squeezed between two fingers.

9. A device according to claim 8 having means which enable to feel the position of maximum extension of said plate and the retracted position thereof, and to retain temporarily this plate when it is in one or the other of these two positions.

10. A slide fastener according to claim 8, wherein said propulsion means consist of protrusions having a hemispheroidal or a hemiovoidal shape.

11. A slide fastener according to claim 8, wherein said propulsion means are provided by the side edges of the slider shaped so that their squeezing between two fingers has the effect of generating a force in the direction parallel to the length of the fastener.

* * * * *